US006319157B1

(12) United States Patent
Broadbent

(10) Patent No.: US 6,319,157 B1
(45) Date of Patent: Nov. 20, 2001

(54) BAT

(76) Inventor: Carl Wayne Broadbent, 34 Stockton Close, Hadleigh, Ipswich, IP7 5SH (GB)

( * ) Notice: Subject to any disclaimer, the term of this patent is extended or adjusted under 35 U.S.C. 154(b) by 0 days.

(21) Appl. No.: 09/402,738

(22) PCT Filed: Apr. 9, 1998

(86) PCT No.: PCT/GB98/00876

§ 371 Date: Oct. 8, 1999

§ 102(e) Date: Oct. 8, 1999

(87) PCT Pub. No.: WO98/44999

PCT Pub. Date: Oct. 15, 1998

(30) Foreign Application Priority Data

Apr. 10, 1997 (GB) ..... 9707286

(51) Int. Cl.[7] ..... A63B 69/00
(52) U.S. Cl. ..... 473/446; 473/457
(58) Field of Search ..... 473/457, 446, 473/564–568; 463/47.2

(56) References Cited

U.S. PATENT DOCUMENTS

| | | | | |
|---|---|---|---|---|
| 236,234 | * | 1/1881 | Lee | 463/47.2 |
| 637,261 | * | 11/1899 | Irving | 84/387 R |
| 805,132 | * | 11/1905 | Gubbins | 473/564 |
| 2,987,317 | * | 6/1961 | Acevedo | 463/47.2 |
| 3,618,945 | | 11/1971 | Kuchar et al. . | |
| 3,671,039 | | 6/1972 | Niewolak . | |
| 3,848,871 | | 11/1974 | Sweet et al. . | |
| 4,378,113 | * | 3/1983 | Piccini | 437/457 |
| 4,836,541 | | 6/1989 | Henley . | |
| 4,951,948 | | 8/1990 | Peng . | |
| 5,150,896 | | 9/1992 | Holmes . | |
| 5,456,461 | | 10/1995 | Sullivan . | |
| 5,593,158 | | 1/1997 | Filice et al. . | |
| 5,605,325 | | 2/1997 | Haringa . | |

FOREIGN PATENT DOCUMENTS

WO9323122 11/1993 (WO) .

* cited by examiner

*Primary Examiner*—Mark S. Graham
(74) *Attorney, Agent, or Firm*—Howell & Haferkamp LC

(57) ABSTRACT

A bat has a grip portion and an elongate, rotationally symmetric playing surface. The playing surface continuously increases in diameter towards its outer end, and the outer end is the widest part of the bat. The surface can be covered with a friction-enhancing material. The bat can be used, together with a conventional soccer ball, as a soccer practice aid.

20 Claims, 2 Drawing Sheets

BAT

FIELD OF THE INVENTION

This invention relates to a bat, for use as a training aid for ball games, in particular for soccer (Association Football).

BACKGROUND OF THE INVENTION

The main type of soccer training which can be carried out by a person practising on their own relates to ball control skills, where the ball is kept under close control with the feet and/or the head, and it is widely acknowledged that this type of training is very useful in developing soccer skills.

Carrying out such practice on one's own can however be frustrating, particularly for those less skilled because if the ball is not properly controlled, it will roll or bounce away from the player who will have to spend time retrieving it before the exercise can be started again.

Recognising this problem, several soccer training devices have been designed to assist in this type of soccer practice. These devices all work by attaching a line to the ball, and either attaching the other end to the player (for example by a belt) or having the player hold the other end of the line whilst he or she is practising. In some of these training devices, the line is attached to the ball by placing the ball in a string bag attached to the end of the line.

Although such devices are commercially successful, they have significant disadvantages. Firstly, because the ball is tethered, it is not free to move in entirely the same way as an untethered ball. Secondly, the presence of a string bag around the ball means that the contact between the player's foot and the ball is distorted. Thirdly, there is a danger that the tether line may become caught around the player's legs or entangled with itself or with other objects.

Fourthly, if the ball is kicked hard, it can rebound and strike the player which is not always desirable.

SUMMARY OF THE INVENTION

Baseball bats are known from, for example, U.S. Pat. Nos. 4,836,541 and 4,951,948 and 5,456,461. It is of the essence both in the game of baseball and in practice for that game, that the bat be swung at the ball so that the ball can be hit a long distance by the batsman. This is of no assistance in soccer training.

The present invention seeks to overcome some or all of these difficulties, and provides a bat for use as a training aid for ball games, the bat being generally elongate in form, with a grip portion at one end and a rotationally symmetric elongate playing surface extending from the grip portion to the opposite end, the playing surface increasing in diameter as it extends from the grip portion to the opposite end, with the point of greatest diameter being at the opposite end and there being a shoulder at the opposite end at which the diameter of the bat increases substantially relative to the diameter of the major part of the length of the bat.

With such a bat, a player wishing to practice soccer skills alone can use an untethered ball and will hold the bat in one hand, whilst kicking or heading the ball. If the ball goes out of control, it can be tapped back towards the player by hitting it with the bat, the playing or hitting surface of which is designed so that a ball which is hit by the bat will tend to be diverted towards the player. The presence of a shoulder at the remote end of the bat encourages this. The player could use two bats, one in each hand.

In one embodiment, the playing surface is in the form of a right circular cone, with a cone angle of between 5° and 15°. However the playing surface may alternatively be in the form of a trumpet shape so that, when seen in cross section, the sides of the playing surface are concave and there is a substanstial increase in diameter at the remote end, and there is a substantial increase in diameter at the remote end.

The playing surface is preferably covered with a high friction coating, such as a rubber coating, so that when a ball is hit the ball does not slide on the surface. This will make it easier for the player to ensure that when he hits the ball, the ball is directed back towards himself. This surface should preferably be non-absorbent.

The opposite end of the bat may have a removable end cap, the cap forming the point of largest diameter of the bat. The cap may screw onto a threaded boss on the end of the bat, and the peripheral walls of the cap may be parallel sided, or tapering to merge with the tapered playing surface of the bat.

The bat may have an interior cavity, and access to this cavity can be had by removing the end cap. If desired, the cavity can be filled with a weighting material (such as water or sand) to achieve a desired balance for the player.

It may be desirable for the contours of the end cap not to merge with the tapered shape of the playing surface, but to be slightly larger in diameter to form a shoulder which will enhance the likelihood of a ball being returned to the player when hit by the bat, when the point of contact with the ball takes place at the opposite end of the bat.

The bat may be made from wood, from a metal such as aluminium or, most probably, from a fibre reinforced composite.

The grip portion may be constructed in the same way as the grip portion of a tennis or squash racket.

The overall length-of the bat is preferably between 400 and 1000 millimetres, with the most preferred length being between 500 and 800 millimetres. Different length bats may be sold, with shorter bats being appropriate for younger children. The diameter of the playing surface at its smallest diameter may be between 30 and 40 millimetres, and at its point of greatest diameter between 100 and 200 millimetres. The most preferred dimensions are in the centre of these ranges.

The invention will now be further described, by way of example, with reference to the accompanying drawings in which:

DESCRIPTION OF PREFERRED EMBODIMENTS

Figure 1:
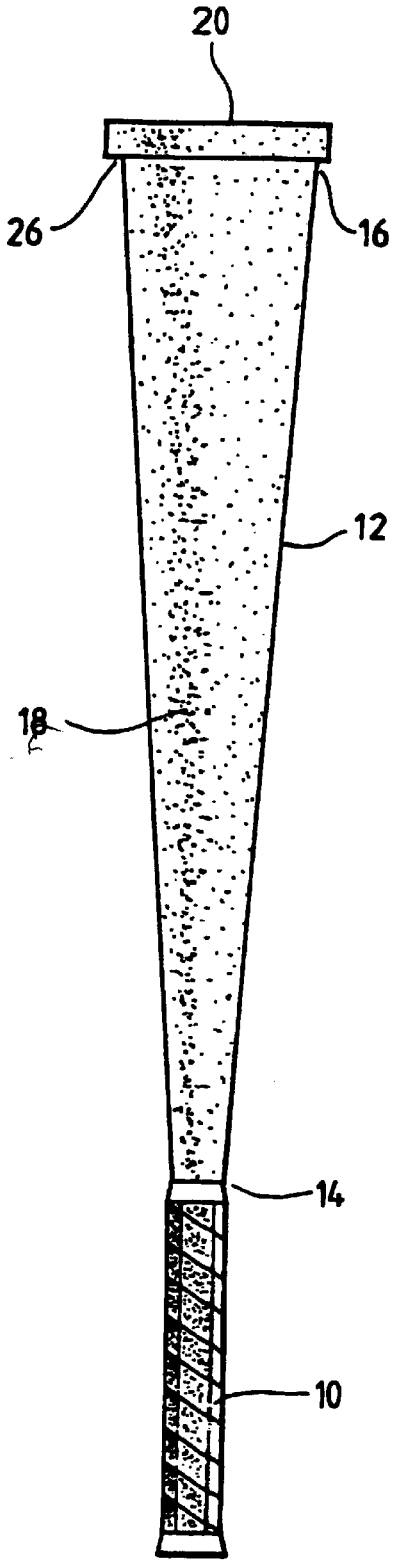
FIG. 1 shows a first embodiment of a bat in accordance with the invention.

The bat shown in FIG. 1 has a grip portion 10 with generally parallel sides wound with a grip, in the manner conventional for, e.g., tennis and squash rackets. The grip probably only needs to be long enough to be held by one hand as it is unlikely that a player will want to hold it with two hands.

The bat has a playing surface 12 which tapers from a small diameter end at 14 to a large diameter end at 16. In FIG. 1, the playing surface 12 is straight sided and has a constant taper angle over its length.

Figure 3:
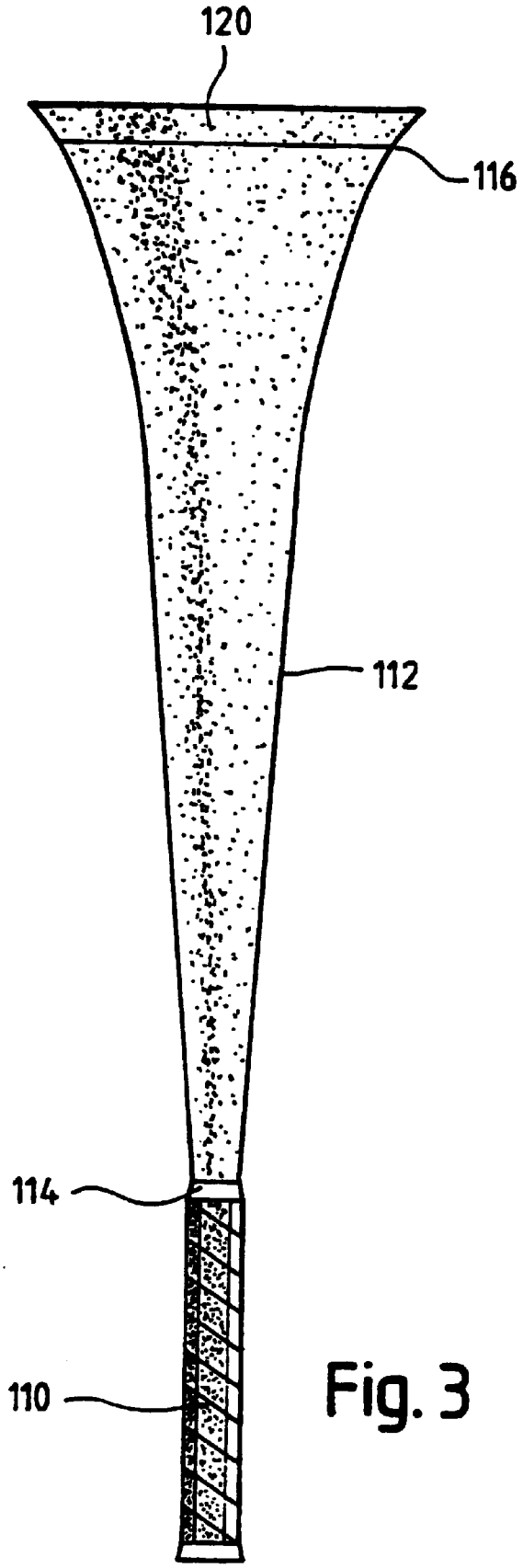
FIG. 3 shows a second embodiment of the bat in accordance with the invention.

FIG. 3 shows an alternative embodiment where the playing surface 112 has concave sides and where the taper angle continually increases from the small diameter end 114 to the large diameter end 116.

The playing surface 12 is covered with a thin layer 18 of a rubber or rubber-like material to give it high friction properties. This can be seen particularly in FIG. 2. the surface may be a pimpled rubber surface, with the pimples facing out, as used on table tennis bats.

Figure 2:
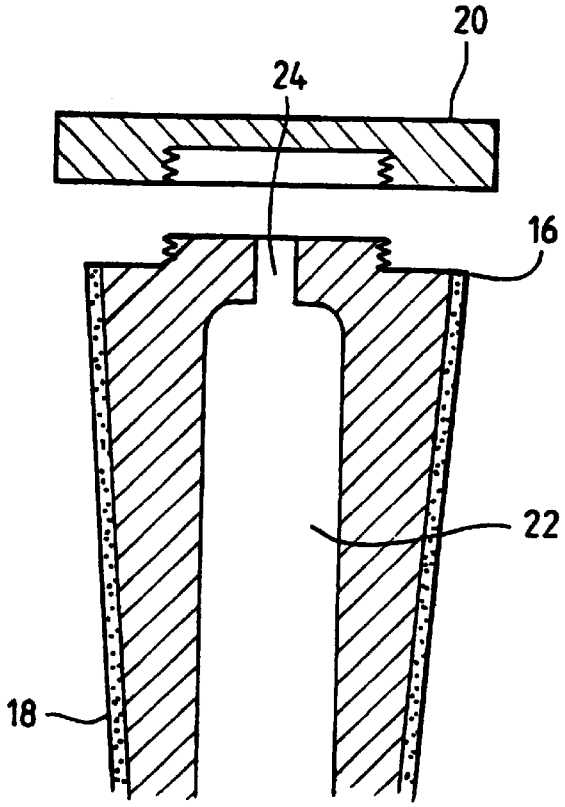
FIG. 2 is a partial cross section through the bat of FIG. 1.

At the large diameter end 16, the bat has a removable base cap 20. FIG. 2 shows how this screws onto a thread at the far end of the bat. The bat may have a hollow interior at 22, with the hollow interior being accessible through an opening 24 after the cap 20 has been removed. The interior 22 can be used as a ballast chamber for containing the material which will add weight to the far end of the bat to vary its balance.

The end cap and the chamber 22 are however not essential. The bat may be a single unitary solid body.

FIG. 1 shows an end cap 20 which is parallel sided and has a diameter slightly larger than that of the end 16 of the bat, so as to form a shoulder 26. The cap 120 in the embodiment of FIG. 3 has a tapering circumference which merges into, and continues the taper of the shape of the playing surface 112.

Figure 4:
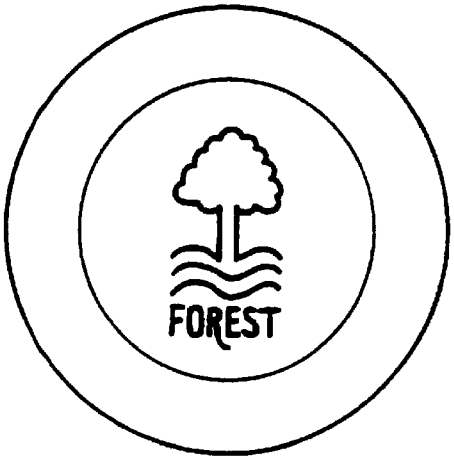
FIG. 4 is a top view of an end cap.

FIG. 4 shows that the large surface area of the base cap 20 can be printed with advertising material or a soccer club logo or any other graphic material.

The bat will be used in the following way.

When a player wants to practice his soccer skills alone, he will take an ordinary soccer and the bat. The bat will be held in one hand and will only be used if the ball goes out of control or threatens to go out of control. If this happens, the player will reach out with the bat and tap the ball to bring the ball back close to the player's body, so that it can be brought under control again. If the ball is travelling away from the player, he can simply reach out and tap it back to himself; if the ball is falling within the vicinity of a foot momentarily being used for standing on, the player can bat it into the air rather than try to kick it. If the ball is out of control and bouncing away, a swift tap towards the ground will generally send it back in the player's direction.

One of the main advantages of this bat as a soccer practice aid, in comparison with the "ball on a string" aids hitherto used is that the ball itself is unrestrained. It therefore behaves in the same manner as a ball on a soccer pitch during a soccer game. Furthermore, if the player wants to vary his practice, for example, by kicking the ball against a wall, he is free to do so or if another person comes to join the practice, then the ball can be kicked between them. The bat can still be useful to recover a ball going out of control, as already described. Practice and/or play can therefore easily be arranged into activities with partners or in groups. The bat requires no setting up and is extremely flexible in the manner of its use. The user might choose to practice some particular skill alone, but then remains entirely free to pass to a partner or a try a shot or dribble, in order to introduce variety.

Some soccer skills may be practiced with this bat which cannot be practised in any other way (or at least not without assistance).

The foremost attributes of the bat are those related to maintaining control of the ball and of recovering the ball after control has been lost. However the bat can also enhance activity with a ball, in tems of the user's own enjoyment and in terms of a benefit in the skill acquisition process. Certain moves and ball drills become possible with a hand-held bat which are not possible without a bat.

In short, the bat is an extremely versatile and user-friendly device whether used seriously to develop a particular soccer skill, or simply for the fun of it.

It allows the user to exert manual control over the ball, while providing a more suitable surface than his own arm or hand and avoiding any conceptual difficulties which he might have with "handling" the ball in a soccer setting.

What is claimed is:

1. A bat for use as a training aid for ball games, the bat comprising:

a rotationally symmetric body having an elongate length with opposite first and second ends;

a grip portion at the first end of the bat body;

a playing surface extending from the grip portion to the second end of the bat body, the playing surface of the bat body having a continuously increasing diameter as it extends from the grip portion to the second end of the body, the playing surface having its greatest diameter at the second end of the body;

the playing surface having a shoulder at the bat body second end, the diameter of the playing surface at the shoulder increases at a substantially greater rate relative to the continuously increasing diameter of the playing surface as it extends from the grip portion to the shoulder; and, the playing surface is covered with a high friction coating.

2. The bat of claim 1, wherein:

the bat body is formed as a right circular cone between the grip portion and the shoulder.

3. The bat of claim 2, wherein:

the right circular cone form of the bat body has a cone angle ranging from 5° to 15°.

4. The bat of claim 1 wherein:

the bat body is formed in a trumpet shape as it extends from the grip portion to the second end of the bat body where in a cross section along the length of the bat body the playing surface is concave.

5. The bat of claim 1, wherein:

the high friction coating is a rubber coating.

6. The bat of claim 1, wherein:

the bat length ranges from 500 to 1000 millimeters.

7. The bat of claim 1, wherein:

the bat length ranges from 500 to 800 millimeters.

8. The bat of claim 1, wherein, the playing surface has a smallest diameter ranging from 30 to 40 millimeters and a largest diameter ranging from 100 to 200 millimeters.

9. The bat of claim 1, wherein:

the bat is adapted as a training aid for soccer ball games.

10. A bat for use as a training aid for ball games, the bat comprising:

a rotationally symmetric body having an elongate length with opposite first and second ends;

a grip portion at the first end of the bat body;

a playing surface extending from the grip portion to the second end of the bat body, the playing surface of the bat body having a continuously increasing diameter as it extends from the grip portion to the second end of the body, the playing surface having its greatest diameter at the second end of the body;

the playing surface having a shoulder at the bat body second end, and the diameter of the playing surface at the shoulder increases at a substantially greater rate relative to the continuously increasing diameter of the playing surface as it extends from the grip portion to the shoulder; and an end cap is removably attached to the second end of the bat body and the shoulder is on the end cap.

11. The bat of claim 10, wherein:

the end cap has a peripheral wall with parallel side surfaces.

12. The bat of claim 10, wherein:

the end cap has a peripheral wall that is tapered and merges continuously with the playing surface of the bat body.

13. The bat of claim 10, wherein:

the bat body second end has a threaded boss and the end cap is removably attached to the bat body second end by being screwed onto the threaded boss.

14. The bat of claim 10, wherein:

the end cap has a configuration that does not merge with the playing surface of the bat body and has a diameter that is larger than the diameter of the bat body at the second end of the bat body, thereby forming the shoulder at the bat body second end.

15. The bet of claim 10, wherein:

the bat has a hollow interior cavity.

16. A bat for use as a training aid for ball games, the bat comprising:

a rotationally symmetric body having an elongate length with opposite first and second ends;

a grip portion at the first end of the bat body;

a playing surface extending from the grip portion to the second end of the bat body, the playing surface of the bat body having a continuously increasing diameter as it extends from the grip portion to the second end of the body, the playing surface having its greatest diameter at the second end of the body;

the playing surface having a shoulder at the bat body second end, the diameter of the playing surface at the shoulder increases at a substantially greater rate relative to the continuously increasing diameter of the playing surface as it extends from the grip portion to the shoulder;

the bat body has a hollow interior cavity; and an end cap is removably attached to the bat body and is removable from the bat body to provide access to the hollow interior cavity.

17. A bat for use as a training aid for ball games, the bat comprising:

a rotationally symmetric body having an elongate length with opposite first and second ends;

a grip portion at the first end of the bat body;

a playing surface extending from the grip portion to the second end of the bat body, the playing surface of the bat body having a continuously increasing diameter as it extends from the grip portion to the second end of the body, the playing surface having its greatest diameter at the second end of the body;

the playing surface having a shoulder at the bat body second end, the diameter of the playing surface at the shoulder increases at a substantially greater rate relative to the continuously increasing diameter of the playing surface as it extends from the grip portion to the shoulder; and the bat is made of a fiber reinforced composite material.

18. The bat of claim 17, wherein:

the second end of the bat body has an end cap and the end cap has a peripheral wall with parallel side surfaces.

19. The bat of claim 17, wherein:

the second end of the bat has a removable end cap and the end cap has a peripheral wall that is tapered and merges continuously with the playing surface of the body.

20. The bat of claim 17, wherein:

the bat has a hollow interior cavity.

* * * * *